US006513178B1

(12) United States Patent
Kelly et al.

(10) Patent No.: US 6,513,178 B1
(45) Date of Patent: Feb. 4, 2003

(54) COT ASSEMBLY

(75) Inventors: Ray G. Kelly, St. Louis, MO (US); Sharon A. Turnbough, Ellisville, MO (US); Malcolm A. Bliss, St. Louis, MO (US)

(73) Assignee: AGI, LLC, Pacific, MO (US)

( * ) Notice: Subject to any disclaimer, the term of this patent is extended or adjusted under 35 U.S.C. 154(b) by 0 days.

(21) Appl. No.: 09/571,132

(22) Filed: May 15, 2000

(51) Int. Cl.[7] ..... A47C 19/00
(52) U.S. Cl. ..... 5/110; 5/114
(58) Field of Search ..... 5/110, 111, 655, 5/187, 114, 112, 113; 119/28.5

(56) References Cited

U.S. PATENT DOCUMENTS

| | | | | |
|---|---|---|---|---|
| 1,566,574 A | * | 12/1925 | Berg | 5/114 |
| 1,820,285 A | * | 8/1931 | Mills | 5/187 |
| 2,871,489 A | | 2/1959 | Emmert | 5/114 |
| 2,924,830 A | | 2/1960 | DeLong | |
| 3,336,060 A | | 8/1967 | Bradford | 287/54 |
| 3,426,367 A | | 2/1969 | Bradford | |
| 3,710,405 A | | 1/1973 | Watts | 5/201 |
| 3,886,606 A | | 6/1975 | Bradford | 5/114 |
| 4,958,390 A | | 9/1990 | Mendenhall | 5/110 |
| 5,003,649 A | | 4/1991 | Kelly | 5/111 |
| 5,960,739 A | * | 10/1999 | Storm | 5/110 |
| 5,992,348 A | * | 11/1999 | Harding | 5/110 |

FOREIGN PATENT DOCUMENTS

| | | | | |
|---|---|---|---|---|
| CH | 261936 | * | 6/1949 | 5/112 |

OTHER PUBLICATIONS

Dandi–Li–On Mats and Cots Product Information.
Comfy Cushion.Comfy Cot Product Information by H & H Industries.
Factory Warehouse Institutional Furniture product information.

* cited by examiner

*Primary Examiner*—Alexander Grosz
(74) *Attorney, Agent, or Firm*—Woodard, Emhardt, Naughton, Moriarty & McNett LLP

(57) ABSTRACT

A cot has a sleeping surface that includes bedding material extending between members of a frame. The frame includes a number of rods connected with a number of comer connectors such that the frame forms the shape of a polygon. Each corner connector has a pedestal extending downwardly to engage the floor and support the bedding material above the floor. The corner connectors have a housing and a pair of coupling portions extending from the housing and an inwardly projecting portion. The bedding material extends within the cot frame such that no openings or gaps are formed between the bedding material and the frame. The cot also has a mechanism for maintaining and adjusting the bedding material surface in a taut condition.

24 Claims, 5 Drawing Sheets

COT ASSEMBLY

BACKGROUND OF THE INVENTION

The present invention relates generally to cots, and more particularly to an improved design for a cot assembly. The invention further relates to cots having various advantageous features, including a continuous bedding surface without gaps, a tensioning means for maintaining the bedding material in a taut condition, and the absence of exposed fasteners and the like.

Cots provide a temporary sleeping surface positioned above the ground or floor. Preferably, the cot is easily moved and transported and/or stored for later use. Cots find a wide variety of uses in many different activities for different ages and sizes of people. In one use, cots are used for camping or other outdoor sleeping settings to avoid contact with the ground. In another use, cots are used indoors by children or preschoolers when it is desired to provide a comfortable sleeping surface that is raised above the floor. Cots are more advantageous than mats or other devices that lie directly on the floor or ground for many reasons. For example, they provide a more comfortable sleeping surface, allow air flow between the floor or ground and the sleeping surface, provide a sleeping surface for a person which is not in contact with the sleeping surface of another person, and do not expose the sleeping person to filth and/or pests which may be present on the floor or ground.

One problem associated with cots is the fact that, when assembled, they require more storage space and can be more cumbersome than mats or sleeping bags. In order to address this problem, various improvements have been made in the design of cots. U.S. Pat. No. 5,003,649 to Kelly provides a nestable cot with a frame that allows a plurality of cots to be nestably stacked one on top of another. Each cot includes four corner connectors, each comer connector configured to receive a pedestal from a corresponding one of the comer connectors stacked thereupon. Thus, the stacked cots occupy a space that has a total height that is less than the sum of the individual heights of each cot, and are more easily stored and handled.

While the '649 patent is a step in the right direction in improving the design of cots, there remains room for additional improvements. One problem with prior art cots is related to the sleeping surface of the cots. Cots typically have a frame for supporting bedding material or fabric that extends between members of the frame. One of the problems with these prior art cots is that gaps are formed between the bedding material and the frame, and these gaps may pose a safety hazard, particularly for children. The potential for injury exists if a child inserts a hand, foot, head or other body part through the gap, where it may become stuck or may cause the child to trip and fall. Also, the cot is more susceptible to being damaged. Cots having such gaps, particularly at the corners, have been prevalent in the prior art and means have not been provided for ensuring against such gaps.

Another problem with prior art cots is related to maintaining the taut condition of the bedding material stretching between members of the frame. Since the sleeping surface is positioned above the floor or ground, when a child or person lies on the cot, the weight on the bedding material at the middle of the cot has the tendency to cause the bedding material to loosen and sag between the members of the frame. This problem worsens over time as the cot is repeatedly subjected to loading. There is a need for a cot that maintains the bedding material in a taut condition, yet also provides for simple and efficient correction of sagging bedding material. It is also desirable that any adjustment mechanism and the associated components require minimum use of tools and/or dismantling. Further, it is preferable that the mechanism is not exposed to the user and does not have any parts which may be encountered or removed by the user, particularly children.

While there have been various approaches to improving the design and construction of nestable cots, the need for improvement still remains. There is needed an improved cot that addresses the problems in the prior art in a reliable, safe, and efficient manner. The present invention satisfies these needs, among others.

SUMMARY OF THE INVENTION

The present invention provides a cot assembly that includes a frame and bedding material extending between members of the frame. The cot assembly is free of any gaps between the bedding material and the frame, thereby protecting against injury which could otherwise result from the presence of such gaps. The cot assembly further includes the combination of a gap-free bedding surface with a means for tensioning the bedding material to maintain it in a desired taut condition. These unique features distinguish the present invention from the prior art and provide greater usable area within the perimeter, increased safety and utility, and other advantages in the use of the cot.

In one aspect of the present invention, there is a cot assembly that includes a frame defining an interior area and an exterior area. The frame has a number of elongated rods with the ends of the rods connected by a number of corner connectors to form a polygonal shape. A pedestal extends downwardly from each corner connector to engage the floor or other supporting surface. The bedding material extends fully to the perimeter defined by the frame in order to avoid undesirable gaps between the bedding surface and the cot frame.

In one embodiment, for example, each corner connector includes an inwardly projecting portion extending into the interior area of the frame. Bedding material is connected with and extends between the rods in the interior area of the frame. The bedding material extends at least to the inwardly projecting portions such that no openings are formed in the interior area between the bedding material and the frame. In a preferred form, each of the comer connectors includes top and bottom flanges extending into the interior area of the frame and defining a slot therebetween for receiving the bedding material.

In yet another aspect of the invention, a cot assembly is provided which includes a frame and bedding material extending gap-free about the frame. Means are provided for positioning and maintaining the bedding material in a taut condition. In one embodiment, for example, at least one of the rods is rotatable with respect to the cot frame and cooperates with a means for holding the rod in a selected rotational position. In a preferred form, the holding means comprises a ratchet mechanism that permits rotation of the rod in a first direction which tightens the bedding material attached to the rod. The holding means prohibits rotation of the rod in the opposition rotational direction in order to maintain the bedding material in the taut condition.

It is an object of the present invention to provide a cot assembly which is simple in construction and which does not present fasteners or the like which may be encountered by or removed by the user, particularly children.

It is a further object of the present invention to provide a cot assembly which includes a frame with a supported bedding material that extends fully within the frame to avoid gaps between the bedding material and frame, thereby preventing the potential for a person by having a part of the body become engaged or trapped within such a gap.

A further object of the present invention is to provide a cot assembly which includes a gap-free bedding surface with the supporting frame and which further includes means for maintaining the bedding material in a taut condition.

These and other objects and advantages of the present invention will be apparent from the following description of the preferred embodiment.

DESCRIPTION OF THE PREFERRED EMBODIMENT

Figure 1:
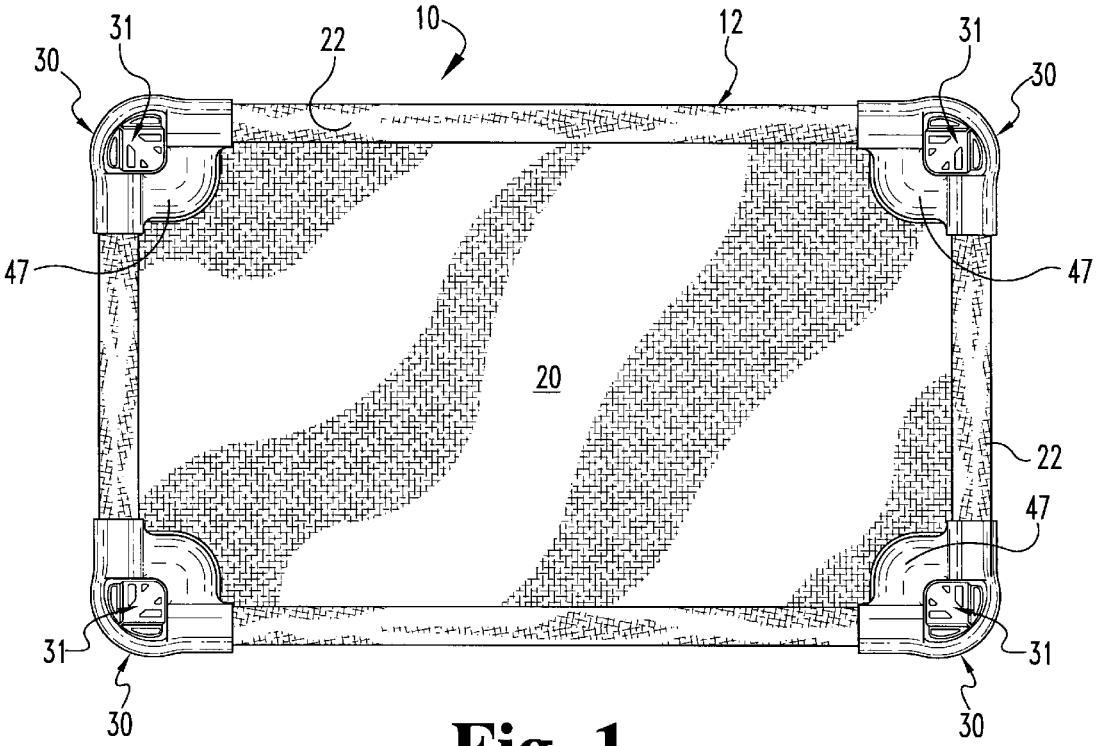
FIG. 1 is a top plan view of a cot assembly according to a preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a cot assembly that has several advantageous design features not available in the prior art. Importantly, the cot includes a bedding material that spans the entire interior of the cot frame without any gaps being present between the bedding material and the frame. Also, this fully spanning bedding material is capable of being adjusted after the cot has been assembled to adjust the tightness of he material. Further, these features are provided in a cot assembly that is simple and reliable in construction, is easily assembled and later adjusted for tautness, and does not have exposed parts that may pose a problem for the user, particularly for children.

The present invention is directed to a cot assembly that has a frame which forms a perimeter which defines an interior area in which a person lying on the cot is supported. Bedding material is connected with and extends between the members of the frame in the interior area such that no openings are formed in the interior area between the bedding material and the frame. In another form of the present invention, a ratchet mechanism 11 is provided to position and maintain bedding material 20 in a taut condition.

Figure 2:
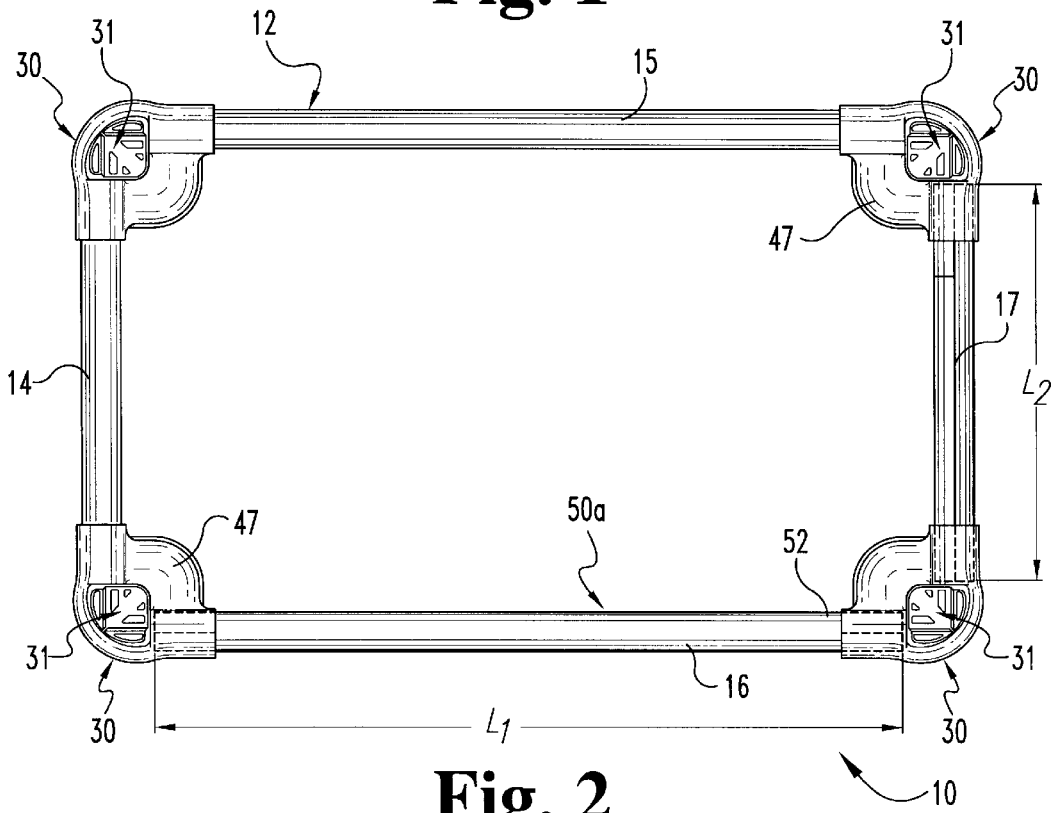
FIG. 2 is a top plan view of the cot frame of the embodiment of FIG. 1.

Referring in particular to FIGS. 1–2, there is shown a cot 10 having a frame 12 including a number of elongated rods 14–17. A corresponding number of corner connectors 30 are connected to respective ends of the rods 14–17 to form the frame 12. It is contemplated herein that frame 12 may have a plan view forming any one of a number of polygonal shapes, such as a rectangle, square, pentagon, a combination of straight and curved members, or only curved members, etc. The frame is shown as consisting of rods which generally comprises hollow tubes either in round or non-round cross-section. As used herein, the term "rods" is used more broadly as encompassing any elongated member which can be coupled together to form a frame for supporting the bedding material used in a typical cot. It will therefore be appreciated that such rods may comprise any of a wide variety of material and shapes depending on the intended use of the cot.

Bedding material 20 is connected with the rods 14–17 of the frame 12 and extends therebetween in the interior area of frame 12 to create a support surface for a person lying on the cot. The bedding material 20 extends horizontally substantially parallel to the floor or ground. Bedding material 20 and frame 12 are supported above the floor or ground by pedestals 33 (FIG. 5) extending downwardly from the corner connectors 30 to suspend the bedding surface above an underlying support surface. The bedding material 20 is made from a material of suitable strength and comfort to support a person lying on the cot 10, the selection of which is within the ordinary skill in the art. Bedding material is typically a relatively thin, flexible and compliant material, preferably sheet-like in shape. The material may be any suitable one, e.g., a natural or synthetic sheeting, fabric, mat, webbing or the like.

As previously described, the bedding material 20 and frame 12 are assembled such that there arc no openings formed between the frame and the bedding material in the interior area of the frame. The bedding material is attached to the frame, and any free portions of the bedding material will at least extend to or overlap with the frame. It will be appreciated that there are numerous ways of attachment to accomplish this gap free construction. Shown herein is a preferred embodiment for providing the gap free condition. As used herein, the term "gap free" or similar terms are used to describe the fact that the bedding material fills the interior of the area defined by the frame perimeter when viewed in the plan view. Moreover, a preferred feature of the present invention is the provision of a gap free condition that further provides for adjusting the tautness of the bedding material, as described hereafter.

The cot frame 12 is illustrated in FIG. 2 and without the bedding material shown to better depict the details of the frame 12 and its components. Preferably, the cot assembly includes side rods 15 and 16 spaced apart and extending in substantially parallel relation. Each of the paired rods 15 and 16 has a length L1 sufficient to accommodate the height of a person lying on the cot. Frame 12 also includes a second pair of spaced end rods 14 and 17 extending in substantially parallel relation and having a length L2 sufficient to accommodate the width of a person lying on the cot. It is of course contemplated that the lengths L1 and L2 may be varied substantially to accommodate different users.

The side and end rods comprise a profile that provides a preferred support structure and shape for the cot. The rods

14–16 are shown as having a cross section with flat top and bottom surfaces connecting rounded sides in a "race track" shape, although other shapes could readily be used, including round, square, oval and many others. The configuration shown has several advantages. The upper support surface is wider than would be provided for a round rod of comparable diameter. The non-round cross section also prevents "racking" when the cots are subjected to a longitudinal twisting force. Racking can occur when the round members of a frame rotate relative the corner connectors, thereby skewing the otherwise flat shape of the cot, and causing a corner of the cot to be spaced from the underlying cot when they are stacked or put on the floor. This can lead to instability of a stack of cots. For the present invention, since non-round rods cannot rotate relative to the corner connectors, the potential for racking is avoided.

Figure 4A:
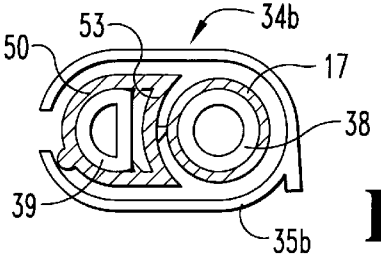
FIG. 4*a* is a cross-sectional view of the corner connector of FIG. 3 taken along lines 4*a*—4*a* of FIG. 3.

The cot preferably includes at least one end member that enables the user to adjust the tautness of the bedding material. In the embodiment of FIG. 2, this is accomplished by means of the rod 17 and a complementary rotational adjustment system. As shown, a mechanism is provided which operates in cooperation with rod 17 to allow for selective rotation of rod 17 In one direction to tighten the bedding material. In particular, this end of the cot includes a combination of rod 17 and an adjacent support member 50. As seen in FIG. 4*a*, rod 17 is round and support member 50 is shaped and positioned complementary with rod 17 so the combination of the two provides an outer cross section profile that is the same as that for the rods 14–16. This enables the rods and corner connectors to be interchangeables.

The assembly of the cot frame is straightforward. The rods can be readily connected with the corner connectors in any of a variety of ways. As will be apparent from the later description of the corner connectors and associated components, the rods may be attached to the corner connectors by press fit, gluing, mechanical fastening or any other means, with a simple mechanical fit of the components being preferred to simplify assembly and facilitate disassembly if that becomes desired. Further, the combination of the bedding material with the frame assembly will provide another means for maintaining the frame members in the assembled condition. It is a feature of the present invention that no screws, pins or other fasteners are required to hold the cot together, and therefore such fasteners are not exposed to the user, and cannot be removed by the user.

Bedding material 20 is attached to the cot frame. Such attachment may take many forms. In the preferred embodiment, the bedding material includes a plurality of sleeves 22, each configured to be received over any of the non-adjusting rods, such as rods 14–16. In an alternate method of attachment, bedding material 20 extends around the exterior portion of a rod and is connected to the rod by suitable fasteners, the selection of which is within the ordinary skill in the art. In view of the intended rotation of rod 17 for adjustment of tautness, this method of attachment is appropriate for such an adjusting-type rod. In any event, bedding material 20 is sized such that when the members of frame 12 and corner connectors 30 are assembled, as described above and shown in FIG.1, the bedding material 20 extends between the members of the frame 12 and fills the interior area of frame 12.

Figure 5:
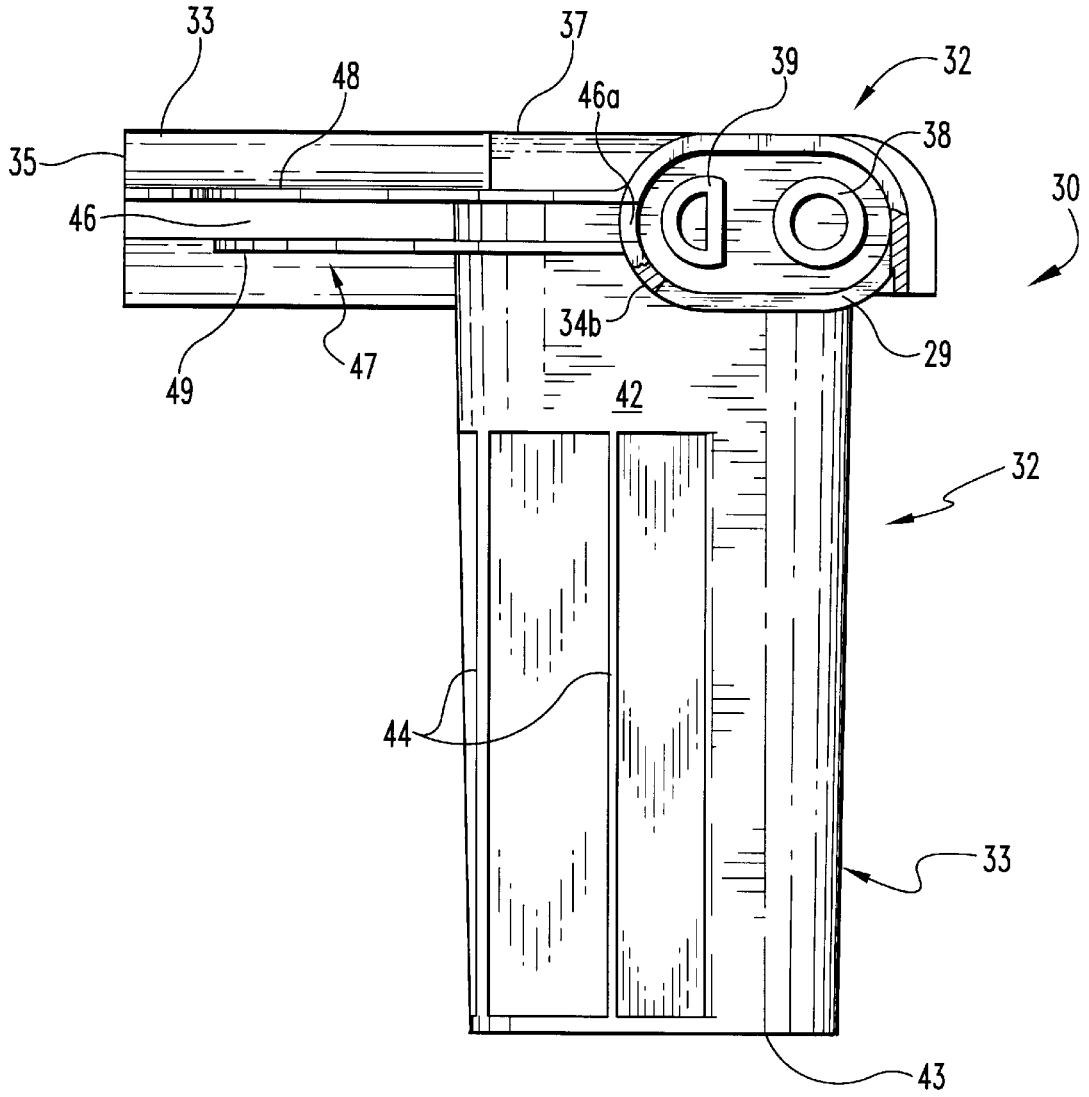
FIG. 5 is an elevational view of an comer connector comprising a portion of the cot assembly of FIG. 1.
Figure 6:
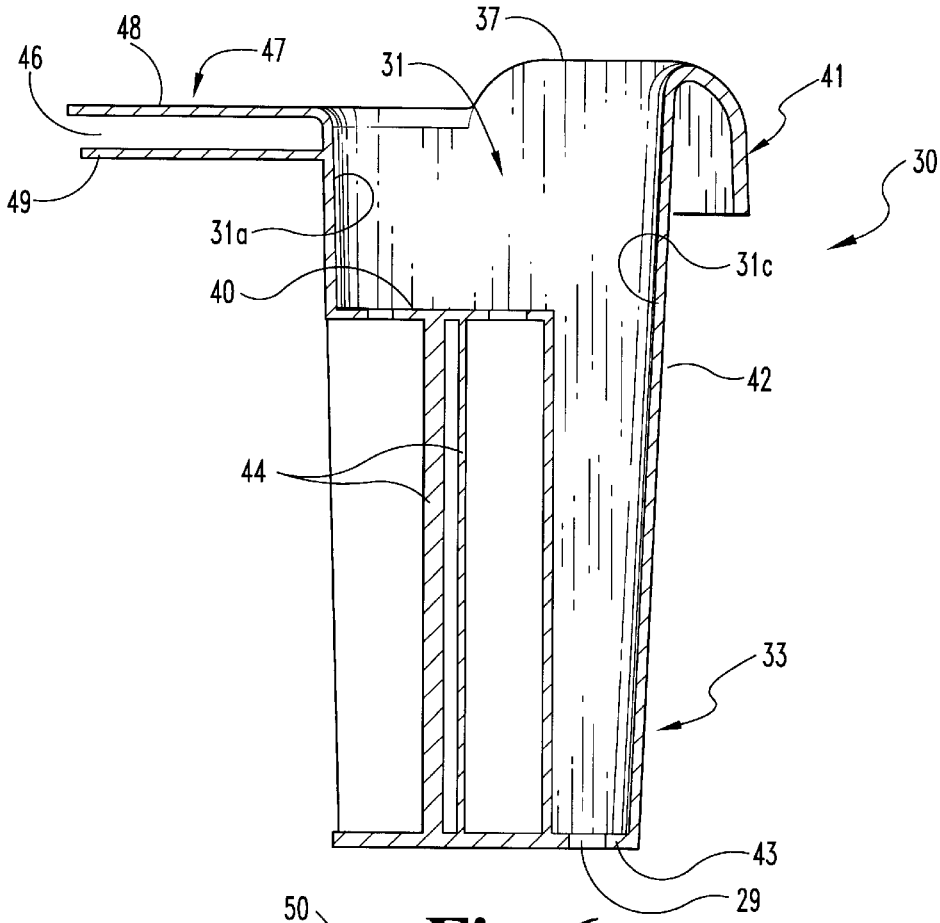
FIG. 6 is a section of the corner connector of FIG. 4 taken through line 6—6.

Each of the corner connectors 30 includes a housing 32 having a top portion 37 (FIG. 5). Housing 32 has a first coupling portion 34*a* and a second coupling portion 34*b*. Coupling portions 34*a* and 34*b* extend generally perpendicular to one another and are configured to receive corresponding ends of rods 14–16 and/or rod 17 and support member 50.

First coupling portion 34*a* includes a first sleeve 35*a*, and second coupling portion 34*b* includes a second sleeve 35*b*. Each of the first and second sleeves 35*a* and 35*b* defines an opening sized to receive the corresponding ends of the members of frame 12. Each of the coupling portions 34*a* and 34*b* further includes a first connector 38 and an adjacent second connector 39 extending outwardly into the sleeves 35*a* and 35*b*. First connector 38 and second connector 39 connect the rod members and assemblies of frame 12 with comer connector 30.

Preferably, the first connector 38 is circular in cross-section, as shown in FIG. 5, and sized so that a hollow end of rod 17 can be connected to the connector 38 to be rotatable about the connector. The second connector 39 is semi-circular in cross section and sized to receive a hollow end of support member 50 in non-rotational engagement. The combined outer perimeter of the adjacent first and second connectors 38 and 39 defines a racetrack shaped cross section that is sized to non-rotatably connect the hollow end of a rod 14 to corner connector 30. The present invention also contemplates other cross-sectional shapes for rods 14–16 and the corresponding first and second connectors 38 and 39 as would occur to one of ordinary skill in the art.

Figure 4:
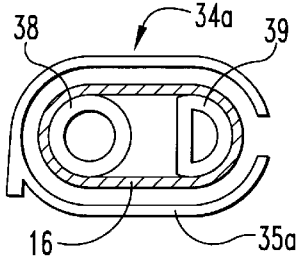
FIG. 4 is a cross-sectional view of the corner connector of FIG. 3 taken along lines 4—4 of FIG. 3.

More particularly, the preferred embodiment shown in the drawings provides a coupling system which advantageously can be combined either with the non-adjusting rods such as 14–16 or the adjusting rod 17 and its associated adjustment mechanism. Referring to FIG. 4, an elevational view looking toward the coupling member 34*a* shows that the rods, such as 14, is received within the sleeve 35*a* of coupling member 34*a* and about the connectors 38 and 39. By comparison, it is shown in FIG. 4*a* that the same connectors 38 and 39 are useful for connecting the rod 17 and support member 50, respectively.

Other cross sections for support member 50 and second connector 39 are also contemplated, so long as there is engagement therebetween preventing rotation of the support member 50. In one alternate embodiment, the first and second connectors 38, 39 are replaced by a single connector having a racetrack shaped perimeter for receiving the rod 14 thereover. Such an embodiment would be particularly desirable in a cot assembly that only includes rods 14. Other cross-sections for rod 14 and connectors 38 and 39 are also contemplated herein as would occur to one of ordinary skill in the art.

Pedestal 33 is defined by an outer wall surface 42, which tapers to a reduced cross-section as it extends downwardly to bottom 43. Pedestal 33 has a height from the floor to the coupling portions 34*a* and 34*b* that positions bedding material 20 above the ground or floor. Housing 32 also defines pocket 31 positioned between the coupling portions 34*a* and 34*b*. Pocket 31 includes substantially vertical inner walls 31*a*, 31*b* and 31*c* on the interior portion of the pocket 31. Inner walls 31*a* and 31*b* preferably taper slightly inwardly towards inner wall 31*c* as each extends downwardly towards a pedestal support surface 40 positioned within pocket 31. Inner wall portion 31*c* also tapers slightly inwardly towards inner walls 31*a* and 31*b* as it extends down to bottom 43 of pedestal 33. A plurality of struts 44 extend between bottom 43 and support surface 40, providing stability and strength to the pedestal 33.

The inner walls 31*a*, 31*b* and 31*c* define the pocket 31 in a shape to receive the pedestal of a second cot with the outer surface 43 of the received pedestal in close or abutting contact with the inner walls of pocket 31. Preferably, the interface between the inner walls of pocket 31 and the outer surface of the received pedestal is such that a plurality of cots may be easily stacked and unstacked with minimum exertion or effort. Further, the fit is desirably close enough that it provides stability to a stack of cots.

Bottom 43 defines at least one opening 29 communicating with a hollow interior of pocket 31. Openings 29 provide a passageway for air as a pedestal is inserted into or removed from the pocket 31, thus facilitating the stacking and unstacking of cots. Pocket bottom 40 similarly includes apertures which facilitate the passage of air when cots are being stacked or unstacked.

A rounded overhang 41 extends around the entry to pocket 31 adjacent top 37. Overhang 41 extends between the coupling portions 34*a* and 34*b* to provide a smooth transition therebetween. Overhang 41 also stiffens the overall structure of housing 32, supports the pocket 31 and facilitates efficient stacking of cots by providing an entry portion for the pedestal that is free from rough or sharp edges.

The gap free effect accomplished by the present invention may be obtained in a variety of ways. The bedding material is secured to the cot frame in a position that has the bedding material extending at least to the frame perimeter. Preferably, the bedding material extends at least to an overlap with the frame, and in suitable locations, such as along the side and end rods, the material is directly affixed to the frame.

Figure 3:
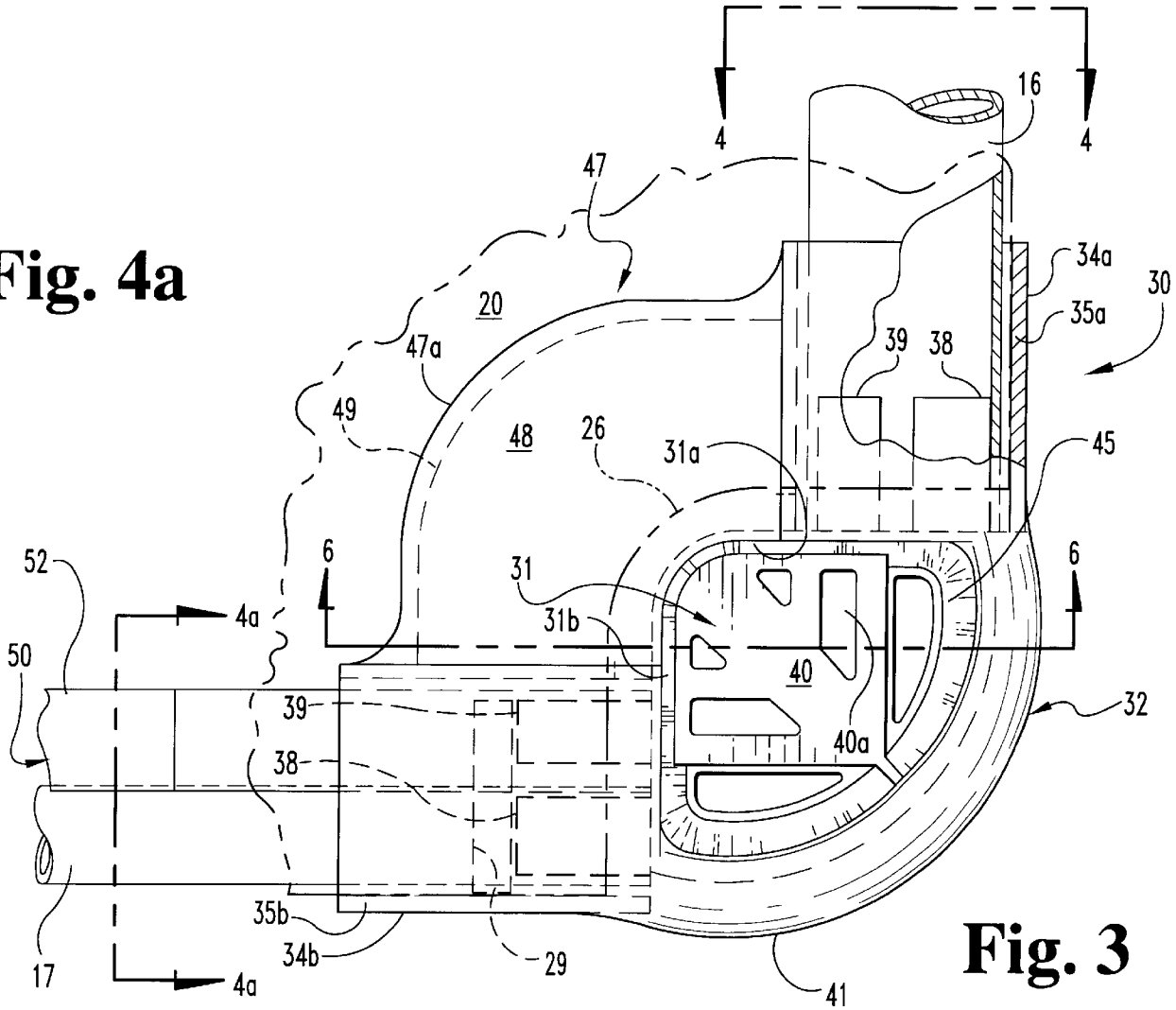
FIG. 3 is a partial top plan view of one corner of the cot assembly of FIG. 1.

In the preferred embodiment shown, corner connector 30 includes inwardly projecting portion 47 extending into the interior area of frame 12. Bedding material 20 is positioned at least in abutting engagement with an edge 47*a* of inwardly projecting portion 47 so that no gaps are formed in the interior area of frame 12 between bedding material 20 and the frame 12. In a most preferred form, bedding material 20 at least overlaps the inwardly projecting portion 47 or is fastened thereto. In a preferred embodiment, inwardly projecting portion 47 includes top flange 48 and bottom flange 49 spanning between coupling portions 34*a* and 34*b* and around the pocket 31 in the interior of the frame 12. Preferably, the bottom flange 49 projects inwardly a distance slightly less than top flange 48. A slot 46 is defined between the top flange 48 and bottom flange 49, the slot 46 communicating with sleeve 35*a* and sleeve 35*b* through apertures, such as 46*a* (FIG. 5). When the cot 10 is assembled, the bedding material 20 has an outer edge 26 (FIG. 3) that is received within slot 46 and extends from first sleeve 35*a* to second sleeve 35*b* within the slot 46. Thus, the risk of injury or damage to the cot 10 due to openings or gaps between frame 12 and bedding material 20 is eliminated.

The present invention contemplates other configurations for inwardly projecting portion 47. For example, although illustrated as having a shape that resembles a quarter-circle in plan view, other shapes for flanges 48 and 49, such as square, rectangular, wedge-shaped, or triangular, to name a few, are also contemplated. In an alternate embodiment, only a single flange 48 or 49 is provided for overlapping bedding material 20. However, it is preferred to provide both a top and bottom flange with a slot therebetween. The top flange 48 shields and protects the edge 26 of bedding material 20, and bottom flange 49 provides additional support along the bottom of bedding material 20 where it spans between the coupling portions. The bedding material 20 may also be fastened to one or both of the flanges 48 and 49 adjacent edge 26, thus providing further support.

As best shown in FIG. 5, the top flange 48 is positioned somewhat below top 37 of housing 32. Slot 46 is preferably aligned with the center of sleeves 35*a*, 35*b* and the members of frame 12, thus providing a smooth transition for the bedding material 20 as it extends between adjacent members of the frame 12.

The present invention provides a novel method for tightening the bedding material on a cot. It will be appreciated that the tightening of the bedding material may be accomplished with a few as one such means, or with as many as four of them. In certain embodiments, a single adjustment means is sufficient, with it being placed on the end or side, depending on the design of the cot, composition of the bedding material and other such considerations. In an alternate approach, a pair of adjustment means are provided, one being along a side and the other being along an end.

Figure 7:
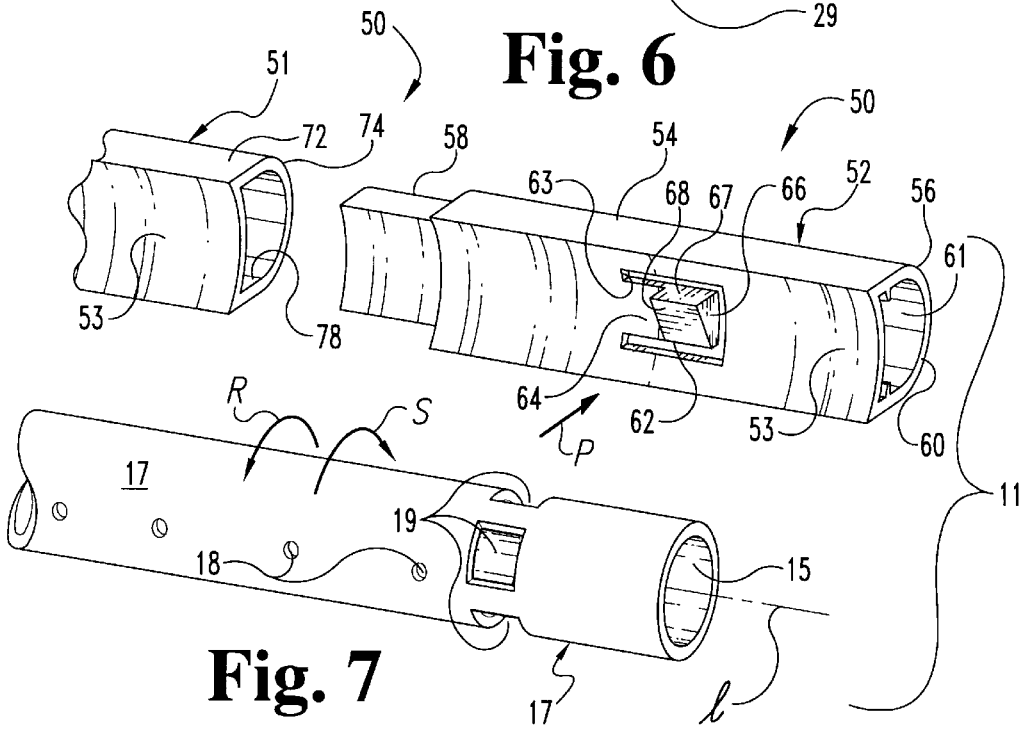
FIG. 7 is an exploded perspective view of a ratchet mechanism according to another aspect of the present invention.

An exemplary embodiment for a tightening system is shown in FIG. 7, which depicts an exploded view of a ratchet mechanism 11 that may be incorporated into cot assembly 10. A portion of support member 50 is illustrated along with the corresponding portion of rod 17. It should be understood that frame 12 may be provided without ratchet mechanism 11.

Support member 50 is shown as including an end piece 52 removably connected with an extended connecting member 51. End piece 52 includes a body 54 and an insertion end 56 having an interior wall 60 defining a cavity 61. A second connector 39 is received within cavity 61 to connect with the end piece 52. End piece 52 further has a reduced-size engagement end 58 adapted to be slidingly and non-rotatably received within the cavity 78 formed at end 74 of connecting member 51. The connecting member 51 has a body 72 with a length sized to extend from end piece 52 to a second corner connector 30. At this opposite end, connecting member 51 is either directly connected with a second connector 39, or a mirror-image end piece 52 and associated ratchet type mechanism could be employed.

Assembled support member 50 has a concave surface 53 extending along its length for nestably positioning rod 17 therealong. End piece 52 has an aperture 62 formed in concave surface 53 that communicates with cavity 61. Integrally formed with and engaged at edge 63 of the aperture 62 is a tang 64 that projects into the aperture 62. Tang 64 substantially occupies the aperture 62; however, it is deflectable inwardly with respect to surface 53 of end piece 52 along edge 63. Tang 64 has a wedge-shaped projection 66 that includes a top edge 67 and sloped surface 68. The projection 66 extends outwardly from concave surface 53 towards the adjacent rod 17. The tang 64 deflects into cavity 61 when pressure is applied in the direction of arrow P.

Rod 17 has a cylindrical outer wall and defines a hollow interior 15. Rod 17 has a plurality of holes 18 along its length to receive fasteners (not shown) therethrough. The fasteners extend through the bedding material 20 positioned around the rod 17 and prevent relative movement therebetween. The fasteners may be rivets, screws, bolts, or the like. In a preferred approach, hooks are welded into the bedding fabric and the hooks are in turn received within the holes 18. Another preferred approach is to use ultra frequency welding to attach tabs onto the fabric for reception by the holes. Alternatively, other attachment means could be used, such as gluing, taping, clamping, etc. Located at the end of rod 17 are several slots 19 communicating with hollow interior 15. The slots 19 are positioned such that they align with and are sized to receive projection 66 of end piece 52 when the support member 50 and rod 16 are engaged to corner connector 30.

Corner connector 30 defines a tool opening 29 formed in the bottom portion of the wall of sleeve 34*b*, as shown in FIG. 5. The tool opening 29 is to be located where rod 17 is connected with corner connector 30. Tool opening 29 is positioned adjacent to but beyond the end of first connector 38 so that there is no interference between the first connector 38 and a tool inserted through opening 29. While tool opening 29 is illustrated in FIG. 4 on sleeve 34*b*, it is also contemplated herein that tool opening 29 could be positioned on sleeve 34*a*, or that both first sleeve 34*a* and second sleeve 34*b* are provided with tool openings 29. When frame 12 is assembled, the slots 19 are aligned with tool opening 29 formed in the bottom of sleeve 34*b* such that a tool may be inserted through the opening 29 and into one of the slots 19.

Ratchet mechanism 11 functions as follows. The top surface 67 of projection 66 engages the rod 17 at an edge of one of the plurality of slots 19 to prevent rotation of the rod 17 about axis 1 in the direction indicated by the arrow S. If the rod 17 is allowed to rotate in the direction of arrow S, the bedding material 20 will sag. Ratchet assembly 11 allows bedding 20 to be made taut and remove any sag that may be present by rotating the rod 17 about axis 1 in the direction indicated by arrow R. The rod 17 may be rotated by extending a tool, such as a screwdriver or other elongated member, through opening 29 and into one of the slots 19. The bedding material is made taut by rotating the rod 17 in the direction R. The wedged shaped projection 66 flexes into cavity 61 as the bottom portion of the projection is rotated past the previously engaged slot 19. The edge of the previously engaged slot 19 applies pressure along the sloped surface of projection 66, gradually flexing the projection 66 further into cavity 61. When the rod 17 is rotated so that the edge of an adjacent slot 19 moves past top surface 67, the projection 66 returns to its at rest position and is received within the adjacent slot 19. The adjacent slot 19 supports the rod 17 as described above and resists rotation in the direction of arrow S. The above steps may be repeated as necessary to achieve the desired rotation of rod 17 and consequent tensioning of bedding material 20.

The tensioning mechanism shown in the preferred embodiment is a simple, reliable system that is totally concealed. No fasteners or other devices are required that project from the cot assembly. At the same time, the mechanism can be easily accessed for purposes of adjustment, and only a simple tool such as a screw driver is required.

Figure 8:
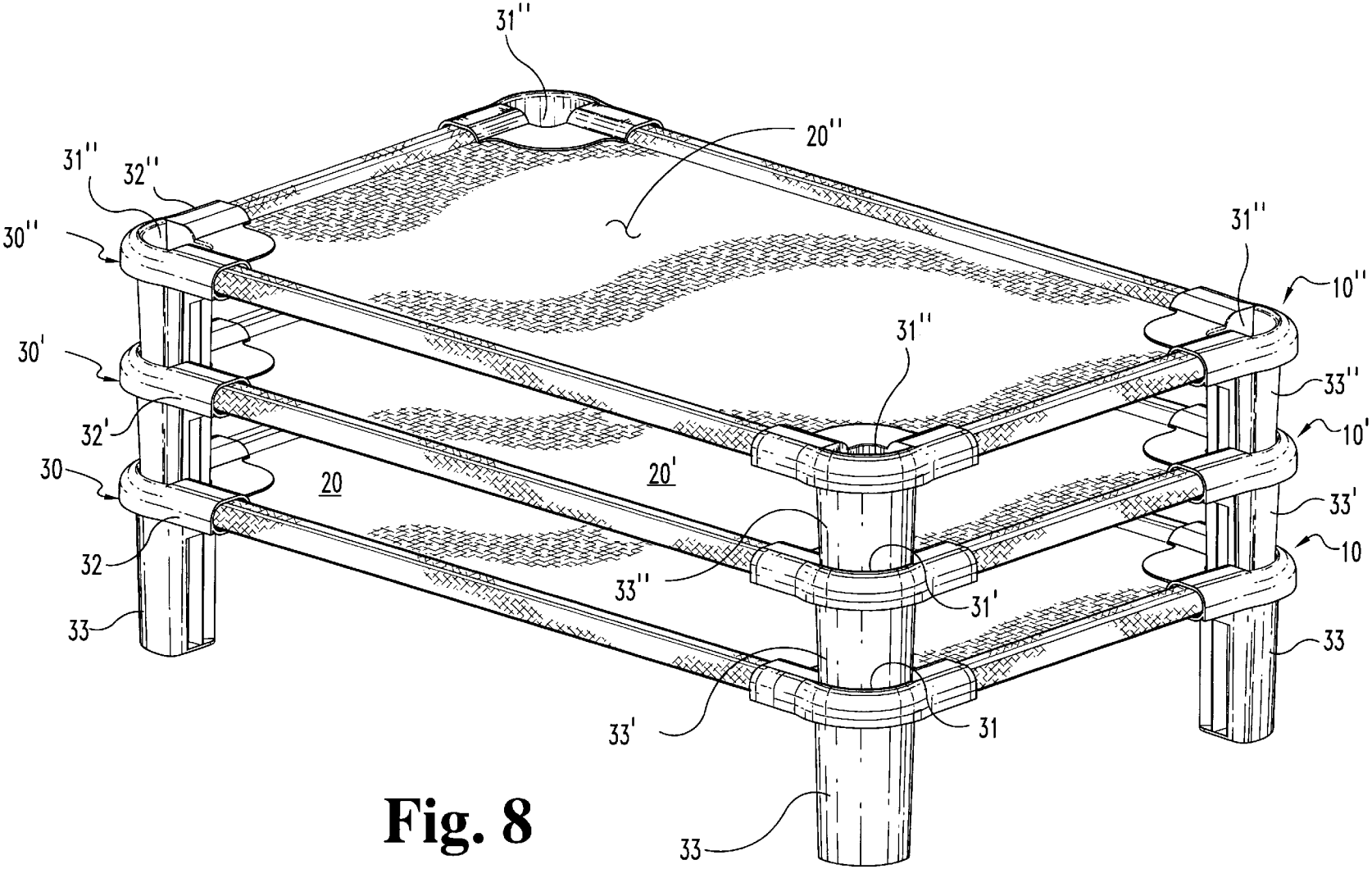
FIG. 8 is a perspective view of three cot assemblies of FIG. 1 nestably stacked one upon another.

Referring to FIG. 8, each of the corner connectors 30 includes a housing 32 defining a pocket 31 that allows a plurality of cots 10 to be nestably stacked one upon another. For example, the pocket of one cot is sized and configured to slidably and removably receive a pedestal of the corner connector of a second cot. As an example, FIG. 8 illustrates three cots 10, 10', and 10" nestably stacked one on top another. Each of the corner connectors 30, 30', 30" includes a pedestal 33, 33', 33" extending therefrom. At least a portion of the height H of pedestals 33' of cot 10' and pedestals 33" of cot 10" are received within corresponding ones of the pockets 31 of cot 10 and the pockets 31' of cot 10', respectively. Thus, the stacked height of cots 10, 10', and 10" is less than the sum of the heights of the individual cots.

Variations in the configurations of the adjustment mechanisms are contemplated and are well within the skill in the art. While support member 50 has been illustrated as being formed by end piece 52 and connecting member 51, it is contemplated that connecting member 51 may be integrally formed with end piece 52 to form support member 50. However, the use of such separate pieces 51 and 52 has advantages in some applications, including greater flexibility and lower costs in design and fabrication. Variations in the position and location of ratchet mechanism 11 are also contemplated herein as would occur to one of ordinary skill in the art.

Further, it will be appreciated that other means to hold the rod 17 against rotation could similarly be used. The design shown herein has certain advantages, however. For example, the design results in a ratchet mechanism that has an outer profile that matches that for the alternative, non-adjusting rods. Therefore, the parts are readily interchanged to produce cots with varying numbers and position of adjustment devices. Moreover, the adjustment rod assembly obtains the same broad upper surface, and the associated advantages described earlier, even though the rotating rod 17 is of much lower diameter. These and other advantages are achieved with the preferred embodiment, but alternate designs are contemplated, particularly where some or all of these advantages are not considered to be significant for a given application.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cot assembly which comprises:

a frame forming a perimeter and defining an interior area within the perimeter;

means for supporting said frame above an external support surface; bedding material secured to said frame, said bedding material completely filling the interior area defined by said frame, whereby there are no gaps between said bedding material and said frame in which a part of a person's body may be received;

tensioning means for varying the tension of said bedding material;

wherein said frame comprises several elongated rods interconnecting with several comer connectors to form a rectangular perimeter; and, wherein said tensioning means includes means for rotating at least one of the rods.

2. A cot assembly which comprises:

a frame forming a perimeter and defining an interior area within the perimeter;

means for supporting said frame above an external support surface;

bedding material secured to said frame, said bedding material completely filling the interior area defined by said frame, whereby there are no gaps between said bedding material and said frame in which a part of a person's body may be received;

wherein said frame comprises several elongated rods interconnecting with several corner connectors to form a rectangular perimeter;

wherein each of the comer connectors includes an inwardly projecting portion extending into the interior area of said frame, said bedding material extending at least to said inwardly projecting portions such that no openings are formed in the interior area of said frame; and, wherein said bedding material is secured to the inwardly projecting portions.

3. A cot assembly which comprises:

a frame forming a perimeter and defining an interior area within the perimeter, means for supporting said frame above an external support surface;

bedding material secured to said frame, said bedding material completely filling the interior area defined by said frame, whereby there are no gaps between said bedding material and said frame in which a part of a person's body may be received;

wherein said frame comprises several elongated rods interconnecting with several corner connectors to form a rectangular perimeter;

wherein each of the comer connectors includes an inwardly projecting portion extending into the interior area of said frame, said bedding material extending at least to said inwardly projecting portions such that no openings are formed in the interior area of said frame; and, wherein each of the corner connectors includes a pair of the rods being connected therewith, each corner connector including a housing, a first end portion extending from the housing along a portion of the length of one of the rods connected therewith, and a second end portion extending from the housing along a portion of the length of the other of the rods connected therewith.

4. The cot assembly of claim 3 in which said supporting means comprises pedestals attached to and extending downwardly from the corner connectors of said frame.

5. The cot assembly of claim 4 in which each housing includes a pocket configured for nestably receiving a pedestal of a second cot assembly.

6. The cot assembly of claim 3 wherein each of the inwardly projecting portions includes a top flange and a bottom flange extending into the interior area of said frame between the end portions, the top and bottom flanges defining a slot therebetween, said bedding material being received within the slot.

7. The cot assembly of claim 6 wherein the first end portion and the second end portion each define a hollow sleeve, the slot communicating with the hollow sleeves, said bedding material extending between the sleeves.

8. The cot assembly of claim 6 wherein the bottom flange projects further into the interior than the top flange.

9. A cot assembly which comprises:

a frame defining an interior area and an exterior area, said frame including a number of elongated rods and a number of corner connectors connecting with the ends of a pair of associated rods such that said frame forms a polygon shape, each of the corner connectors including a pedestal extending downwardly therefrom to engage a support surface; and bedding material connected with said frame and extending between the rods in the interior area of said frame, the corner connectors including means for receiving said bedding material so that no openings are formed in the interior area of said frame between said bedding material and the comer connectors; and, wherein said frame includes a support member adjacent to and extending along the length of at least one of the rods, the support member having ends non-rotatably engaged to a corresponding one of a pair of the comer connectors.

10. The cot assembly of claim 9, wherein each of the comer connectors includes a housing, the housing including a first end portion extending along a portion of the length of one of the rods connected therewith, the housing further including a second end portion extending along a portion of the length of the other of the rods connected therewith.

11. The cot assembly of claim 10, wherein the support member includes a ratchet mechanism and the at least one rod defines a plurality of slots adjacent the ratchet mechanism, the ratchet mechanism being engageable with one of the slots to prevent rotation of the at least one rod in a first direction while allowing the at least one rod to be rotated in an opposite second direction to engage another of the slots upon application of a rotational force about the longitudinal axis of the at least one rod.

12. The cot assembly of claim 11, wherein the ratchet mechanism includes a deflectable wedge-shaped portion projecting into one of the slots, the wedge shaped portion having a top surface engaging an edge of the slot and a sloped surface extending downwardly from the top surface to deflect the wedge-shaped portion away from the at least one rod as the rod rotates in response to the rotational force.

13. The cot assembly of claim 11, wherein the support member defines a concave surface adjacent to and extending along the length of the rod, the ratchet mechanism being positioned on the concave surface.

14. The cot assembly of claim 11, wherein at least one of the end portions receiving the at least one rod defines a tool opening aligned with the plurality of slots for receiving a tool engageable with one of the slots for applying the rotational force.

15. The cot assembly of claim 11, wherein each of the pair of corner connectors includes a first connector and a second connector projecting from said housing into the coupling portion for receiving the at least one rod and the support member, the first connector rotatably connecting the at least one rod to the corner connector and the second connector non-rotatably connecting the support member to the comer connector.

16. The cot assembly of claim 15, wherein the at least one rod has a circular cross section and the support member has a semi-circular cross-section.

17. The cot assembly of claim 16, where the rods other than the at least one rod have a race-track shaped cross-section.

18. A cot assembly, comprising:

a frame defining an interior portion and an exterior portion, said frame including:

a number of elongated rods;

a number of comer connectors, each of the comer connectors connected with one end of each of a pair of the rods so that said frame forms a polygon shape;

a support member adjacent to and extending along at least one of the number of rods, the support member having opposite ends non-rotatably engaged to a corresponding pair of the corner connectors, the at least one rod having a plurality of slots adjacent one of the opposite ends of the support member;

a pedestal extending downwardly from the comer connector to engage the floor;

bedding material engaged to and extending between the number of rods in the interior area of said frame; and means associated with said frame for positioning and maintaining said bedding material in a taut condition, said means for positioning and maintaining including a ratchet mechanism on the support member engageable to one of the slots of the at least one rod.

19. The cot assembly of claim 18, wherein the ratchet mechanism prevents rotation of the rod in a first direction and allows the rod to be rotated in an opposite second direction to engage another of the slots upon application of a rotational force about the longitudinal axis of the rod.

20. The cot assembly of claim 19, wherein the ratchet mechanism includes a deflectable wedge-shaped portion projecting into one of the slots, the wedge-shaped portion having a top surface engaging an edge of the slot and a sloped surface extending downwardly from the top surface that deflects the wedge-shaped portion away from the rod as the rod rotates in response to the rotational force.

21. The cot assembly of claim 20, wherein the corer connect or engaged to the at least one rod end defines a tool opening aligned with the plurality of the slots for receiving a tool engageable with one of the slots to apply the rotational force.

22. The cot assembly of claim 18, wherein the support member defines a concave surface adjacent to and extending along the length of the at least one rod, the ratchet mechanism positioned on the concave surface.

23. The cot assembly of claim 18, wherein the support member includes an end piece connecting with one of the pair of corner connectors at one end and engaged at another end to a connecting member, the connecting member extending from the end piece and connecting wit h the other of the pair of corner connectors.

24. The cot assembly of claim 23, wherein the ratchet mechanism is on the end piece.

* * * * *